United States Patent [19]

Brazier

[11] Patent Number: 4,530,870

[45] Date of Patent: Jul. 23, 1985

[54] FLOOR MAT COMBINATION AND DETACHABLY SECURABLE FLOOR MAT

[75] Inventor: Peter C. Brazier, Heath & Reach, England

[73] Assignee: Walk Off Mats Limited, England

[21] Appl. No.: 492,590

[22] Filed: May 9, 1983

[51] Int. Cl.[3] ..... B32B 3/02; B32B 33/00

[52] U.S. Cl. ..... 428/95

[58] Field of Search ..... 428/95

[56] References Cited

U.S. PATENT DOCUMENTS 2,763,587 9/1956 Masland ..... 428/95

3,817,015 6/1974 Frangos ..... 428/95

FOREIGN PATENT DOCUMENTS 1164470 9/1969 United Kingdom .

2066061 7/1981 United Kingdom .

*Primary Examiner*—Marion E. McCamish

*Attorney, Agent, or Firm*—Dann, Dorfman, Herrell and Skillman

[57] ABSTRACT

A floor mat has its lower surface formed with one or more abutments located within its perimeter and extending generally perpendicular to the mat. The abutments are arranged to abut against or to be in close proximity to complementary abutments on a detent which is detachably secured to a floor surface, e.g. a carpet, when the mat covers the detent and thereby to restrict or prevent lateral movement and/or rotation of the mat relative to the detent.

11 Claims, 5 Drawing Figures

FLOOR MAT COMBINATION AND DETACHABLY SECURABLE FLOOR MAT

Figure 1:
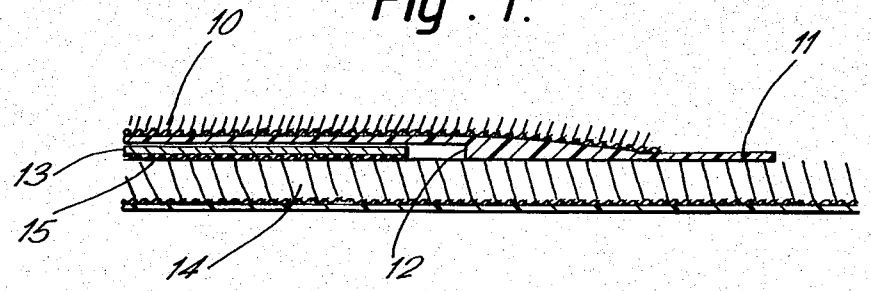

The present invention relates to a floor mat combination which prevents a floor mat e.g. a rubber or similarly backed mat such as a dust control mat, from moving laterally and/or rotating on a floor, particularly a carpeted, fabric-tiled or felted floor, as the mat is walked over. It also relates to a floor mat therefor.

An ordinary rubber-backed mat placed on a carpet tends to move laterally, or 'creep', during use. This movement is believed to be caused by the directional lie of the pile of the carpet which produces a different frictional effect on the mat as pressure is applied by the foot compared to that when pressure is released, so that the mat has a net movement in the direction in which the pile lies.

A mat walked over equally in two opposite directions will always move in one direction, which may be at an angle to the walking directions if the pile is not in line with the axis of the mat. Movement of the mat can also be produced on a variety of floor surfaces if during use it is walked over in one direction only, or if there is a tendency for the user to turn on the mat in one direction. For example, a mat may be situated at a shop counter in such a position that customers tend to walk on to the mat from one direction and, after being served, to turn in the direction of the shop door to step off the mat. In such a location, the mat may 'creep' according to the lie of the carpet pile and rotate.

This 'creep' and rotation effect is sufficient to make it impractical to use a backed mat on pile carpets and certain other flooring materials without some means of preventing the movements from taking place.

Various methods have been used in the past to overcome this difficulty but all of them have disadvantages of one sort or another, especially in connection with dust control mats. These methods include the following:

1. A looped fabric such as Velcro has been attached to the back of the mat and a similar or complementary fabric attached to the floor, e.g. the carpet. Such a mat is disclosed in GB Patent Specification No. 1518045. This provides satisfactory adhesion when the mat is new. Dust control mats, however, require regular washing and during this process the looped fabric picks up lint which is difficult to remove from the loops. They therefore become ineffective and there is a need for a more permanent solution to the problem.

2. Non-woven fabric treated with a 'tacky' latex adhesive has been placed between the mat and the floor, so that the fabric adheres to the flooring and the back of the mat adheres to the top of the fabric. However, when the mat is lifted from the floor for maintenance, the fabric is often lifted with the mat. It will then not re-adhere to the flooring since its surface has picked up fibres and dust from the flooring which spoils its adhesive quality. Moreover, due to eventual loss of tackiness, the fabric requires regular replacement and this is not an easy operation. Accordingly, there is a need for a simpler solution.

3. Frames which fit around the outside edges of the mat have been used, forming a wall which restrains the movement of the mat. The frame has a bottom so that it forms a tray, and some frames are manufactured which actually clip the mat in place by means of the sides of the tray overlapping the mat. These trays are expensive to provide; they project substantially above the level of the flooring; and they collect dirt inside the frame which necessitates an extra cleaning operation. There is a need for a cheaper and less clumsy solution.

The present invention seeks to provide an improved floor mat combination which does not 'creep' in use.

According to the present invention there is provided a floor mat combination comprising one or more locking elements so-called detents, detachably securable to a floor surface and a mat having its lower surface formed with one or more abutments located within its perimeter and extending generally perpendicular to the mat, the abutment(s) being arranged so that when the mat covers the locking element or elements, abutment(s) on the mat abut against or are in close proximity to complementary abutment(s) formed by the side walls of the locking element(s) on the detent or detents and thereby prevent or restrict lateral movement and/or rotation of the mat relative to the locking element(s).

The invention also provides a floor mat for use in such a combination.

The invention is of particular value in connection with mats whose lower surface is formed of rubber or other flexible sheet material such as PVC or other plastic materials. Such mats frequently have a pile or fabric upper surface, which may or may not extend to the outer edge of the mat and a rubber or like sheet backing and mats of this type are widely known for use as dust control mats.

Preferably the lower surface of the mat is formed, e.g. by moulding, with an integral downwardly-facing recess or with a ridge or step forming a projection, said recess or projection having a side wall which is generally perpendicular to the mat surface. The recess on projection is substantially flat, and, if desired, more than one such recess or projection may be formed in the lower surface of the mat. The recesses and projections must provide a plurality of abutments generally perpendicular to the mat and facing in at least two different directions if 'creep' in all directions is to be prevented. Preferably two or more of such abutments are joined together at their respective ends to form a corner. The abutment(s) on the mat need not be exactly perpendicular to the mat surface but may be inclined at an angle to it provided that the angle is sufficient to prevent the mat sliding up over the detent. For best results an angle of 60° or more is used and about 90° is preferred.

For best results the abutments on the mat should be deep enough that the mat does not readily ride up over the fixed locking element(s) on the floor but not so deep as to produce a markedly uneven upper surface when the mat is in position on the floor covering or overlying the locking element. Preferably, when the mat has a fabric or pile covering on a part of its upper surface surrounded by an uncovered border area, each of the projections or recesses is formed in that part of the lower surface beneath the covered area, because this minimizes any visible impact of the underlying projection(s) or locking element(s).

In many instances a small amount of movement of the mat can be tolerated and so the abutments on the mat and locking element(s) need not be arranged to abut against one another permanently during use of the mat but can simply be arranged so that they are in close proximity and thus the recess may conform generally to the outline of the locking element and may define limits on the movement of the mat relative to the locking element(s).

The locking elements detachably securable to the floor surface may be platens or the like which may be fixed to the floor covering, e.g. a carpet, by adhesives, tape, screws, nails, pins or in any other convenient way or may be fixed to the underlying floor either directly or through the floor covering. The platens or the like will have side walls forming abutment(s) complementary to the abutment(s) formed by wall means on the lower surface of the mats and may be larger or smaller than the mats or the same size as them. Preferably however they are smaller. They may be formed of wood, metal, plastics, rubber or any other relatively rigid material. A particularly desirable combination is a rectangular mat having a rectangular recess, so that the recess generally conforms to the outline of the platen in its lower side and a rectangular platen slightly smaller than the size of the recess.

Figure 2:
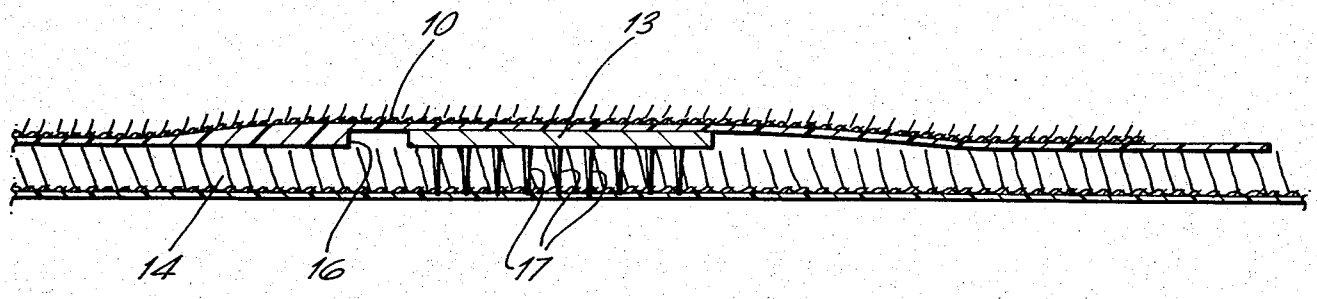
Figure 3:
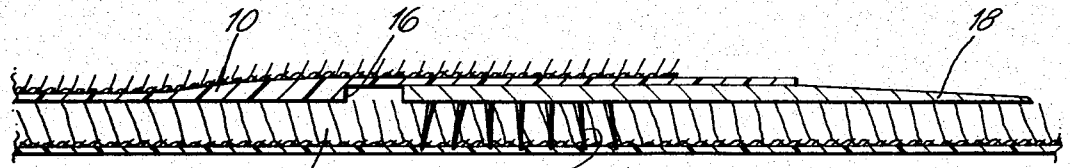
Figure 4:
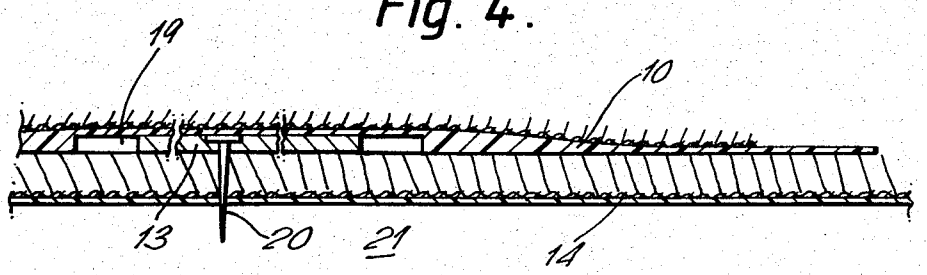
Figure 5:
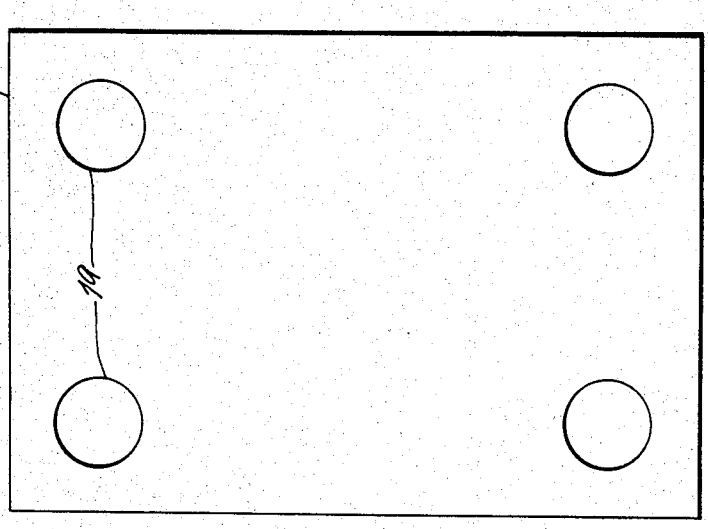

In the accompanying drawings,

FIGS. 1–4 are partial vertical sections of alternative embodiments of the invention and FIG. 5 is a plan view of the embodiment shown in FIG. 4 from below.

One simple embodiment of the invention shown in FIG. 1, comprises a rectangular mat 10, e.g. of dimensions 800×1200 mm, including a plain rubber border 11, e.g. 20 mm in width, extending around the four edges of the mat. The mat has a rectangular, inward facing step or wall 12, e.g. 700×1100 mm in dimension, in its backing, approximately twice the thickness of the backing in depth. The resulting rectangular recess is centered in the backing and extends to the same distance, e.g. within 50 mm, from each of the outside edges of the mat and has an area about 80% of the area of the mat. The edge wall of the recess forms a 3 mm step having a face at approximately 90° to the back of the mat. The thickness of the backing sheet material in the recess on one side of the wall 12 is less than the thickness of the material outside the recess on the other side of the wall.

This mat is designed to be placed on a rectangular platen 13, slightly, e.g. 20 mm, smaller in both dimensions that the recess in the back of the mat, in the specific example mentioned above being 680 mm×1080 mm. i.e. about 76% of the area of the mat. It may be manufactured of hardboard and attached to the carpet by placing between it and the carpet 14 a piece of non-woven fabric 15 coated on both sides with 'tacky' latex adhesive. The platen projects above the carpet by an amount equal to the difference between the thicknesses of the backing material on either side of the wall 12.

Such a mat is restrained from moving in use by the reaction of the side wall of the platen against the step or wall at the edge of the recess in the mat.

Another embodiment is shown in FIG. 2. Here, a recess 16 is formed around the edge of a mat 10, e.g. of dimensions 800 mm×1200 mm, so that a rectangular projection, e.g. 500 mm×900 mm, bounded by an outwardly facing step or wall is formed. The projection occupies about 46% of the mat area, so that the recess around the edge of the mat occupies about 54% of the mat surface area. The platen 13 takes the form of a frame, e.g. 50 mm in width, having a hole in the centre which is larger, e.g. 20 mm larger, then the rectangular projection, the frame extending close to, e.g. within 90 mm of, the edges of the mat. The underside of the frame has projecting stainless steel pins 17 which engage in the pile and backing of the carpet 14, holding the frame in position so that it may react against the movement of the mat.

In a further embodiment shown in FIG. 3, a mat 10 as described in connection with FIG. 2 has a frame 18 larger in external dimensions than the mat and extending to form a decorative effect around its edge. This frame will, however, lie flat to the floor so that there is a minimum possibility of it being tripped over.

In a fourth embodiment shown in FIGS. 4 and 5, the mat 10 has four circular recesses 19, e.g. 150 mm in diameter, in its back—the extremities of which extend close to, e.g. within 75 mm of, the edges of the mat and are equally spaced about the centre lines of the rectangular mat. The platen 13 takes the form of four discs smaller in diameter than the recess of the mat, each fixed to the floor 21 with one nail 20 in the centre of each disc.

In order that the abutments are not deformed readily by lateral forces on the mat they should not be too deep relative to the thickness of the mat in their vicinity. Usually their depth will be less than 3 times the thinnest thickness of the mat in their vicinity. Also, the abutments themselves should not be too thin, measured in a direction perpendicular to the abutments themselves. Preferably the perpendicular distance from the abutment surfaces themselves (through the material of the mat, not through the free space) to the next adjoining free space, either beyond an adjacent abutment or beyond the edge of the mat as the case may be, is at least 10 times the depth of the abutment in question.

Especially where there is only a single locking element, the surface area of the detent is preferably 50 to 85% of the surface area of the mat, but it is possible (as described above) to use a group of small locking elements, although they should not exceed about 4 in number for convenience sake.

It is noted that in each of the illustrated embodiments, the thickness of the flexible sheet material of the mat around its outer edge is the same as the thickness of the mat within the recess, so that the risk of tripping is minimized.

What is claimed is:

1. A floor mat combination comprising at least one means detachably securable to a carpeted floor surface having a locking element projecting upwardly from said floor surface and having side walls facing in at least two different directions, and a mat having a substantially continuous upper surface and a lower surface formed of flexible sheet material, said sheet material having a downwardly-facing recess having an outline adapted to lie in close proximity to the outline of the side wall of said locking element with at least one wall means forming abutments facing opposite to said two different directions within the perimeter of the mat lower surface, said wall means extending generally perpendicular to the mat, the recess of the mat being arranged so that when the mat overlies the locking element, the wall means on the mat is in close proximity to said side walls of the locking element and thereby restricts lateral movement and/or rotation of the mat relative to the locking element in said different directions, the thickness of said flexible sheet material in said recess on one side of the wall means being less than the thickness of the sheet material on the other side of said wall means by an amount approximately equal to the projection of the locking element from the carpeted floor surface.

2. A mat combination as claimed in claim 1, in which the mat is rectangular and said recess in its lower surface is rectangular and spaced inwardly from the side edges of the mat, and the locking element is a rectangular platen slightly smaller than the recess.

3. A mat combination as claimed in claim 1, in which the mat is rectangular and is formed with an annular rectangular recess extending to the side edges of the mat to provide a central platform constituting a projection on the lower surface of the mat, and the locking element is an annular frame having a central rectangular opening slightly larger than the platform, to receive said platform when said annular recess overlies said annular frame.

4. A mat combination as claimed in claim 1, in which said at least two abutments facing in different directions are joined to one another at their respective ends to form a corner.

5. A mat combination as claimed in claim 1, in which said thickness of the sheet material on the other side of the wall means is less than three times the thickness of the sheet material on the one side of the wall means.

6. A mat combination as claimed in claim 1, in which the mat is formed of rubbery material covered on at least part of its upper surface with a pile.

7. A mat combination as claimed in claim 1, in which the surface areas of the recess and the locking element are each 50 to 85% of the surface area of the mat.

8. A mat combination as claimed in claim 1 for use with a carpeted floor surface having a pile face with a directional lie of the pile, wherein said locking element comprises a platen element having anchor means on its underside to releasably anchor said platen relative to the pile face of said floor surface.

9. A mat combination according to claim 8 wherein said anchor means comprises steel pins penetrating through said pile face.

10. A floor mat adapted to be used in combination with a means detachably securable to a floor surface and having locking elements projecting upwardly from said floor surface, the floor mat having a substantially continuous upper surface and a lower surface of flexible sheet material having an edge portion with a reduced thickness and a central portion inwardly of said edge portion with a greater thickness, said edge portion meeting said central portion in wall means forming abutments located within the perimeter of said lower surface and extending generally perpendicular to the lower surface of said mat, the abutments cooperating to define a space of a shape having an outline adapted to lie in close proximity to the outline of said locking elements to engage the same when the mat is laid over the locking elements, and the depth of the abutments corresponding to the thickness of said elements and being less than one tenth of the perpendicular distance from the abutments along the lower surface of and through the material of the mat to the closest adjoining free space.

11. A floor mat adapted to be used in combination with a means detachably securable to a floor surface and having locking elements projecting upwardly from said floor surface, the floor mat having a substantially continuous upper surface and a lower surface of flexible sheet material having an edge portion with a reduced thickness and a central portion inwardly of said edge portion with a greater thickness, the sheet material within said central portion having a recess with a thickness corresponding to the thickness of said edge portion, said recess being defined by wall means forming abutments located within the perimeter of said lower surface and extending generally perpendicular to the lower surface of said mat, the abutments cooperating to define a space of a shape to engage said locking elements when the mat is laid over the locking elements, and the depth of the abutments approximately corresponding to the thickness of said elements and being less than one tenth of the perpendicular distance from the abutments along the lower surface of and through the material of the mat to the closest adjoining free space.

* * * * *

UNITED STATES PATENT AND TRADEMARK OFFICE

CERTIFICATE OF CORRECTION

PATENT NO. : 4,530,870

DATED : July 23, 1985

INVENTOR(S) : Peter C. Brazier

It is certified that error appears in the above-identified patent and that said Letters Patent is hereby corrected as shown below:

Column 2, line 17, delete "on the detent or detents".

Column 3, line 14, after "recess" (first occurrence) delete ", so that the recess generally conforms to the outline of the platen" and insert same after "recess" in line 17.

Column 3, line 41, delete "that" and insert --than--.

Signed and Sealed this

*Twenty-sixth* Day of *November 1985*

[SEAL]

*Attest:*

DONALD J. QUIGG

*Attesting Officer*

*Commissioner of Patents and Trademarks*